US006039131A

United States Patent [19]

Beaton

[11] Patent Number: 6,039,131

[45] Date of Patent: Mar. 21, 2000

[54] DIRECTIONAL DRIFT AND DRILL PDC DRILL BIT

[75] Inventor: Timothy P. Beaton, Houston, Tex.

[73] Assignee: Smith International, Inc., Houston, Tex.

[21] Appl. No.: 08/918,763

[22] Filed: Aug. 25, 1997

[51] Int. Cl.[7] ..... E21B 10/00

[52] U.S. Cl. ..... 175/376; 175/398

[58] Field of Search ..... 175/376, 398, 175/400, 399, 331

[56] References Cited

U.S. PATENT DOCUMENTS

| | | | |
|---|---|---|---|
| 2,953,354 | 9/1960 | Williams, Jr. . | |
| 3,199,616 | 8/1965 | Hjalsten | 175/398 |
| 4,352,400 | 10/1982 | Grappendorf et al. | 175/330 |
| 5,052,503 | 10/1991 | Löf | 175/389 |
| 5,099,929 | 3/1992 | Keith et al. | 175/398 |
| 5,111,894 | 5/1992 | Williams, Jr. | 175/373 |
| 5,176,212 | 1/1993 | Tandberg | 175/333 |
| 5,402,856 | 4/1995 | Warren et al. | 175/57 |
| 5,497,842 | 3/1996 | Pastusek et al. | 175/334 |
| 5,655,614 | 8/1997 | Azar | 175/404 |

OTHER PUBLICATIONS

Diamond Products International; SpeedReamer; (3 p.); undated.

SPE/IADC 29396; New Bi–Center Technology Proves Effective in Slim Hole Horizontal Well; B.C. Sketchler, C.M. Fielder; and B.E. Lee; SPE/IADC Drilling Conference Feb. 28–Mar. 2, 1995 (5 p.).

The American Oil &Gas Reporter; Advances in Bits Give Operators Fresh Look at Maximizing Performance and Cutting Costs; J. L. Prouty; Apr. 1996; (2 p.).

Oil & Gas Journal; Use of Bi–Center PDC Bit Reduces Drilling Cost; R.G. Casto, M. Senese; Nov. 13, 1995; (6 p.).

The American Oil &Gas Reporter; Advances Improve Bi–Center Drill Bits; C.M. Fielder; Apr. 1995; (4 p.).

Diamond Products International; Cutter Technology; The SpeedReamer™ Series; (18 p.); undated.

Diamond Products International; In 1995, Diamond Products International Set 13 of the 17 Drilling Records for Bi–Center Bits.; (4 p.); undated.

Diamond Products International; Bi–Center Bit Runs; Oct. 23, 1996; (pp. 1–6).

Diamond Products International; Bi–Center Hydraulics; A Guideline for Nozzle Selection; Product Bulletin No. 004; 12–29–95; C. Fielder/B. Taylor; (pp. 1–2).

Diamond Products International; Bi–Center BHA Recommendations; A Guideline for Bottom Hole Assemblies; Product Bulletin No. 005; 02–09–96; B. Taylor; (pp. 1–2).

Diamond Products International; SpeedReamer™ ; Initial Field Tests; Offshore Technology Conference 1996; (13 p.).

Diamond Products International; The Latest Generation of Bi–Center Bits; (8 p.); undated.

The American Oil &Gas Reporter; New Bit Designs Reduce Drilling Cost; M. Lee; Apr. 1997; (9 p.).

*Primary Examiner*—William Neuder
*Attorney, Agent, or Firm*—Rosenthal & Osha LLP

[57] ABSTRACT

A PDC bit for cutting a hole below a point in a formation, the diameter of the hole being greater than the diameter of the hole above the point, comprising: a bit body having an axis of rotation, a first cutting portion having a first radial extent from the axis of rotation, a second cutting portion that is not axially spaced apart from the first cutting portion and that has a second radial extent that is greater than said first radial extent, wherein the total imbalance forces resulting from engagement of said first and said second cutting portions with the formation are balanced such that the resulting torque on the bit is minimized and in particular, the component of the torque on the bit about an axis normal to the axis of rotation is minimized. In some embodiments, the bit has a central recessed portion on its face, which receives a short "core" portion that enhances stabilization of the bit.

33 Claims, 6 Drawing Sheets

DIRECTIONAL DRIFT AND DRILL PDC DRILL BIT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates generally to PDC drill bits and more particularly to PDC drill bits that are capable of cutting a borehole that is larger than their own diameter. Still more particularly, the present invention relates to a bi-center PDC bit in which the under-reaming portion is positioned at the end of the bit so as to eliminate the torque that would otherwise result.

Bits that are capable of cutting a borehole that is larger than their own diameter have been known for some time. This capability was often accomplished by using a bit that was truncated across a portion of its circumference, so that the center point of the bit was laterally offset from its axis of rotation. U.S. Pat. No. 2,953,354 discloses a bit of this sort. However, early bits were all diamond bits, having hundreds of natural diamonds on their cutting surfaces. These diamonds, while durable, did not allow for aggressive cutting action. Thus, the amount of cutting performed on each revolution of the bit was relatively small. Because diamond bits do not aggressively engage the formation and because there is no way to control the force with which any given diamond engages the formation, it was not practical to stabilize diamond bits except by providing them with a balanced or inherently stable body shape. Thus, the amount of imbalance force that could be tolerated within a given bit was small. More recently, few experimental polycrystalline diamond compact (PDC) bits have attempted to incorporate an eccentricity. However, these eccentric bits were modifications from existing designs and therefore were not capable of handling the imbalance forces associated with under-reaming. Accordingly, the amount of imbalance force that these bits could tolerate was also small.

A bit having a body that is only slightly eccentric can be tolerated because the mass of the bit body is sufficient to keep it drilling about its intended rotational axis, i.e. drilling a hole slightly larger than its pass-through diameter. The amount of offset or eccentricity that could be used in a diamond bit was thus severely limited, as too much offset would cause the bit to precess, or "whirl" in the hole.

There are many instances in which it is desirable to increase the diameter of a borehole below a certain point in the hole by more than the amount possible with diamond or prior art eccentric PDC bits. The reason for increasing the borehole diameter may be a desire to increase the annular volume between the casing and the drill string to allow better cementing or gravel packing, a need to facilitate liner casing operations in sections where formation swelling occurs, or instances of slim hole high-angle re-entry drilling.

For these reasons, in many of the instances where it is desired to significantly increase the borehole diameter below a certain point, the under-reaming is typically accomplished with a special under-reaming tool. These tools typically comprise extendible reaming arms that are passed through the smaller, upper portion of the borehole in a retracted state, then extended and rotated so as to increase the diameter of a preexisting hole. Because of their relatively large number of moving parts, under-reamers are vulnerable to failure and breakage. In addition, under-reamers must be used in a pre-drilled hole, thus requiring the passage of two pieces of equipment through each length of borehole, namely the smaller diameter bit followed by the under-reamer.

To avoid the disadvantages associated with under-reamers, bi-center PDC bits were developed. Referring to FIG. 1, conventional bi-center bits 10 comprise a lower pilot bit section 12 and a longitudinally offset, radially extending reaming section 14. During drilling, the bit rotates about the axis 16 of the pilot section, causing the reaming section to cut a hole having a diameter equal to twice the greatest radius of the reaming section 14. Prior to drilling however, as the bi-center bit is passed through the upper portion of the hole, it shifts laterally, so that the rotational axis 16 is not centered within the hole. This shifting allows the bit to pass through a hole having a diameter 22 that is smaller than the diameter 24 of the hole that it will drill once it begins rotating. Thus, there are typically three diameters associated with bi-center bits. The first is the diameter 20 of the pilot bit section, which is the smallest diameter. The largest diameter is diameter 24, which is the diameter of the hole cut by the reaming section, and intermediate these is the pass-through diameter 22, which is the diameter of the smallest hole through which the reaming section will fit.

Referring now to FIG. 1A, a simplified profile 50 of a conventional-type bi-center bit is shown. Profile 50 corresponds generally to the prior art bit shown in FIG. 1, but is not intended to be a representation of the profile of the bit of FIG. 1. Profile 50 includes two curved sub-profiles 52, 54. Sub-profile 52 is the profile of the pilot bit and sub-profile 54 is the profile of the reaming section. Each sub-profile 52, 54 comprises a curve $\mathbf{52}_a$, $\mathbf{54}_a$, extending between a radially inner point and a radially outer point and terminating in a gage portion $\mathbf{52}_g$, $\mathbf{54}_g$. The inner point of sub-profile 52 lies on the axis of rotation of the bit. For purposes of discussion, at any given point on either sub-profile the angle between a line perpendicular to the sub-profile at that point and the axis of rotation is defined as a. It can be seen that for the profile shown in FIG. 1A, $\alpha$ increases from zero or negative at the inner point of sub-profile 52 to approximately 90° at the gage portion $\mathbf{52}_g$ of sub-profile 52. At the intersection of sub-profiles 52 and 54, $\alpha$ decreases abruptly before increasing again to 90° along curve $\mathbf{54}_a$.

Still referring to FIG. 1A, when bi-center bits were first developed, the pilot sections 12 of those bits were stabilized in a stand-alone manner. While it was recognized that an imbalance force $F_R$ would result from rotation of the longitudinally spaced-apart asymmetric reaming section, it was believed that stand-alone stability in the pilot section would cause the reaming section 14 to maintain its intended rotational axis and thereby improve the operation of the whole bit. Over time, it was discovered that operation of the bit was actually improved by providing a large imbalance force $F_P$ on the pilot section. Following this development, bi-center bits have been designed so that the imbalance force resulting from rotation of the pilot section, $F_P$, is maximized in a direction opposite to $F_R$, in an effort to mitigate $F_R$ as much as possible.

However, because in a conventional bi-center bit the reaming section is longitudinally spaced apart from the pilot section, the two imbalance forces $F_P$, $F_R$ are axially offset by a distance x, with the result that operation of the bit produces a turning moment on the bit around an axis normal to the rotational axis (an axis normal to the plane of the paper, as drawn). Because the forces are oppositely directed, the turning moment M is equal to the product of the difference between the magnitudes of the two imbalance forces and the distance x:

$$M=(F_P-F_R)\cdot x$$

For example, if $F_P$ is equal to 20% of the weight on bit (0.2 WOB), $F_R$ is equal to 0.3 WOB, and x is 10 inches, the magnitude of the turning moment M will equal the magnitude of the WOB, [10(0.1 WOB)]. If the difference between the magnitudes of the imbalance forces were greater, or if the distance x were greater than 10 inches, as it is likely to be in most conventional bi-center bits, the turning moment M would be even greater. This turning moment renders conventional bi-center bits more difficult to steer and tends to put undue torque on the drill string and other bottom hole assembly (BHA) components, which in turn increases the likelihood of failure and shortens the life of the BHA.

In addition the drilling center of conventional bi-center bits tends to fluctuate, with the result that the borehole does not have a consistent diameter. Finally, the fluid dynamics of bits such as that shown in FIG. 1 tend to be poor, with fluid flow being concentrated in only a few areas, which can reduce bit efficiency.

Hence, it is desired to provide a bi-center PDC bit that is capable of drilling a hole larger than its pass-through diameter and that provides superior directional control and steerability. It is further desired to provide a bi-center bit that has good fluid flow properties, exhibits no fluctuation of its drilling center, and reduces fluctuations in torque on the BHA, both around the drilling axis and perpendicular to it.

BRIEF SUMMARY OF THE INVENTION

The present invention comprises a drill bit having a reaming portion that is not axially offset from the head of the bit. The present bit is designed so that the imbalance forces that result from the cutting action of the reaming cutters are offset as nearly as possible by the forces resulting from the cutting action of the remaining cutters, so that overall the total of the imbalance forces on the bit is minimized. The present bit includes a plurality of blades whose outer edges define a circle. The diameter of this circle is the pass-through diameter of the bit. The axis of rotation of the present bit is not centered within the circumference of the bit. The offset between the axis of rotation and the center of the circumference is what provides the under-reaming capability.

In one preferred embodiment of the present invention, the bit is provided with an internal bearing surface in the form of an axially recessed portion at the center of the bit cone. The recessed portion has substantially smooth cylindrical walls, which terminate at a bottom surface that includes cutter elements corresponding to the cutter elements that would normally be at the center of the bit cone. Alternatively, the walls of the recessed portion can include cutter elements

BRIEF DESCRIPTION OF THE DRAWINGS

For a detailed description of a preferred embodiment of the invention, reference will now be made to the accompanying Figures, wherein.

DETAILED DESCRIPTION OF THE INVENTION

Figure 2:
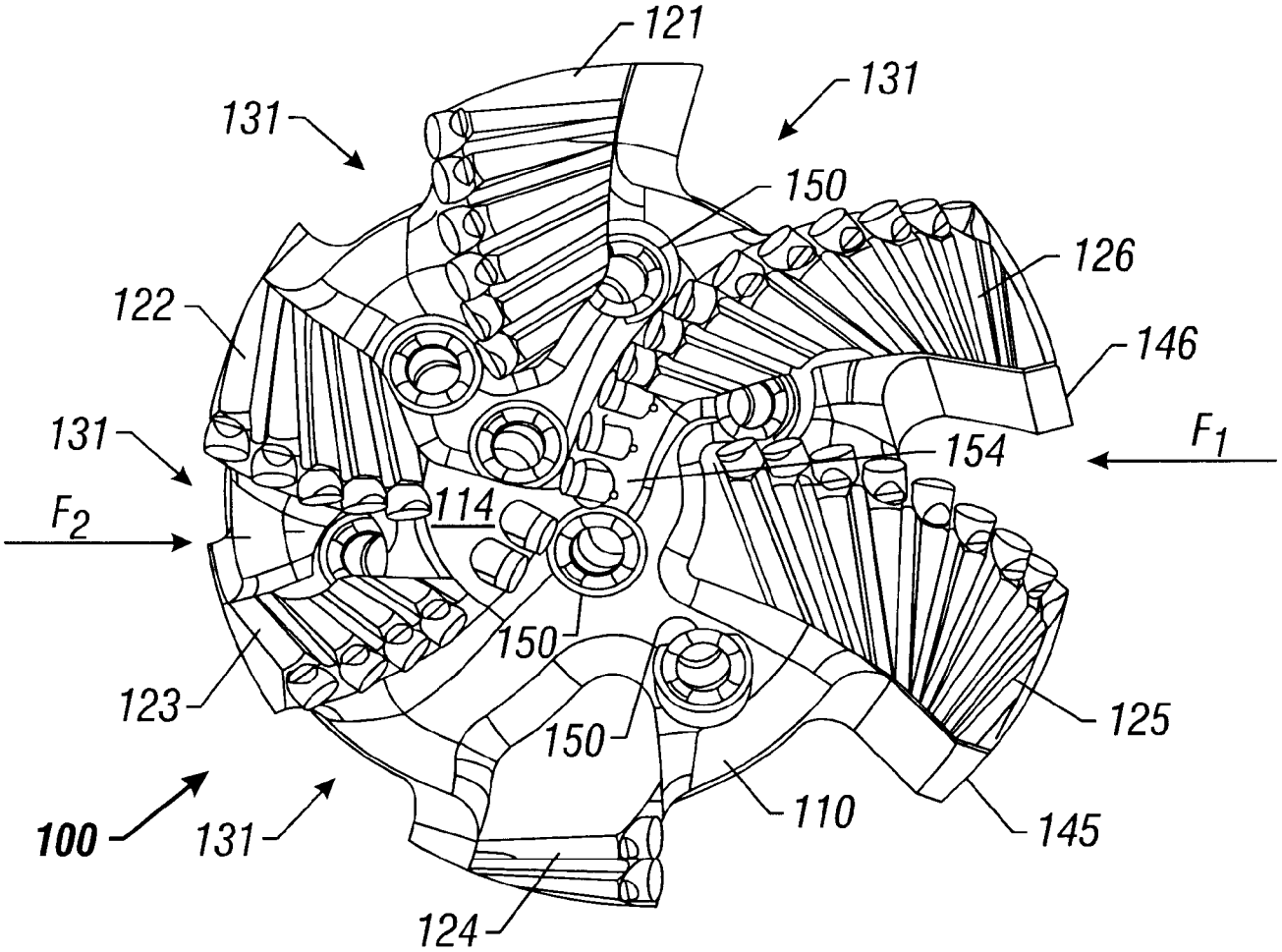
FIG. 2 is a bottom view of a bit constructed in accordance with the present invention.
Figure 3:
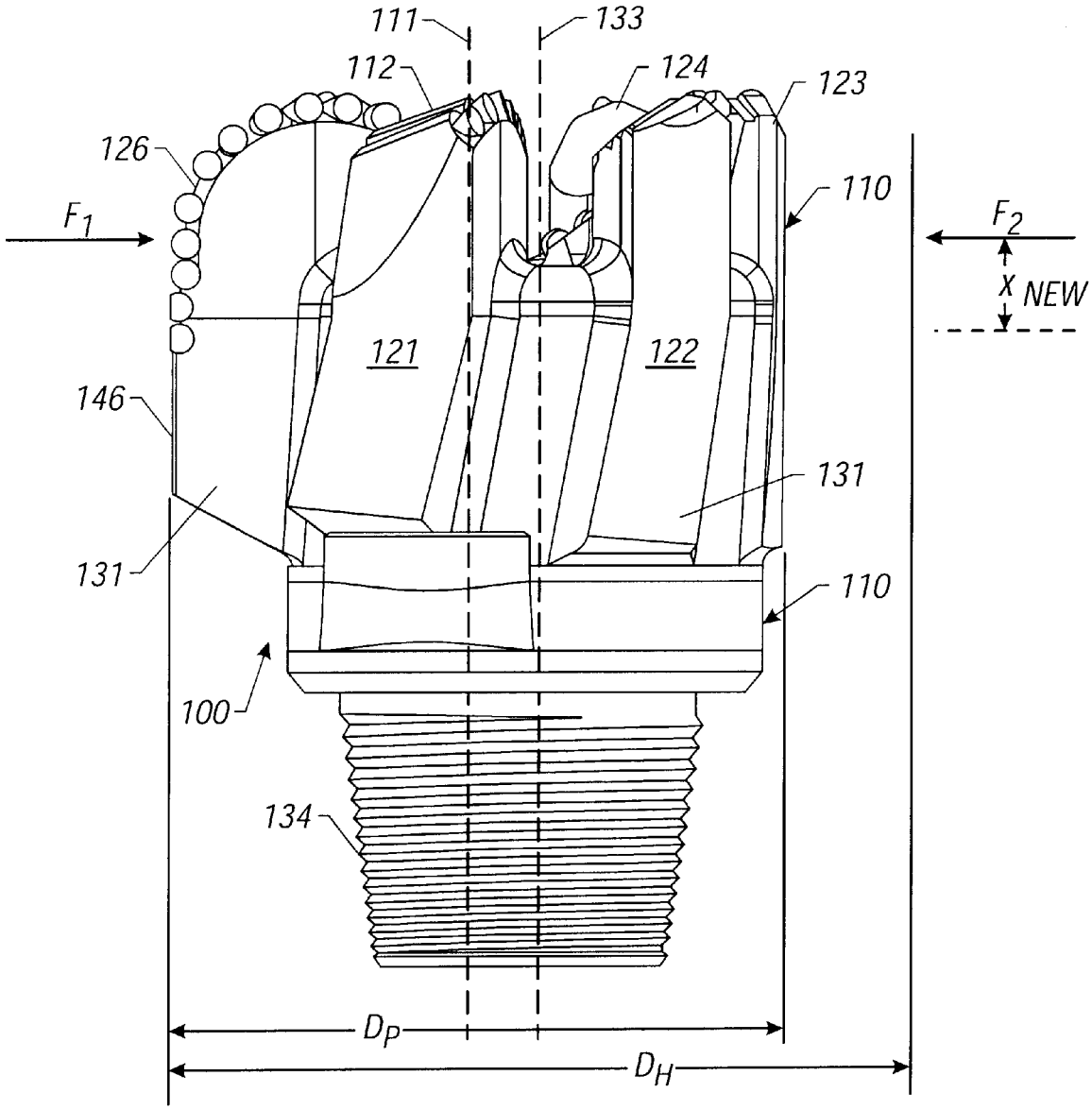
FIG. 3 is a side view of the bit of FIG. 2.

Referring now to FIGS. 2 and 3, one embodiment of the bit 100 constructed in accordance with the present invention comprises a generally cylindrical, one-piece body 110 having an axis 111 through the geometric center of the head of the bit and a cutting surface 112 at one end. Cutting surface 112 is defined by a plurality of blades 121, 122, 123, 124, 125 and 126 extending generally radially from the bit body 110. Between each adjacent pair of blades, a junk slot 131 is defined. Each blade supports a plurality of PDC cutter elements as discussed in detail below. The axis of rotation 133 of bit 100 is defined by the axis of the pin connection 134 (FIG. 3) and does not coincide with the geometric axis 111 of the bit. Bit 100 further includes a plurality of nozzles 150 (FIG. 2), through which drilling fluid (mud) is pumped. It is preferred that the blades 121–126 be configured so as to be sufficiently inflexible to resist the forces applied during drilling. On the other hand, the motivation to prevent blade deflection by increasing the thickness of the blades is balanced by the need to provide adequate junk slots.

Figure 2A:
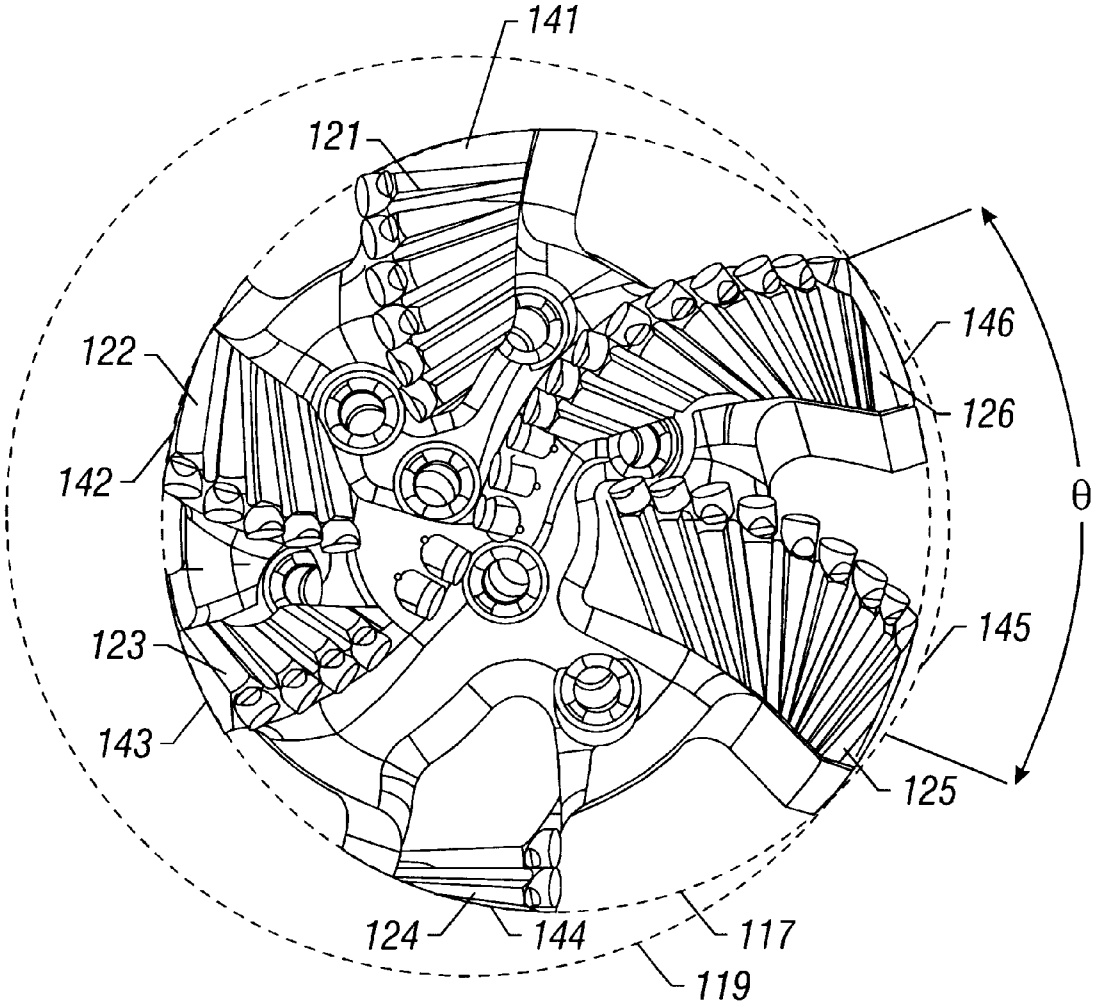
FIG. 2A is the same view as FIG. 2, with circles illustrating the configuration of the present bit superimposed thereon.

Referring briefly to FIG. 2A, the circumference of bit 100 is defined by two circles, namely a pass-through circle 117, whose center lies on axis 111, and a gage circle 119, whose center lies on axis 133. Thus, each blade 121–124 includes a pass-through surface 141–144, respectively, at its radially outermost surface. Pass-through surfaces 141–144 lie on pass-through circle 117. In contrast, the radially outermost surfaces of blades 125 and 126, lie on gage circle 119 and include gage pads 145, 146, respectively. Gage pads 145, 146 are preferably provided with conventional inserts 147, that maintain the diameter of the borehole wall. Together, the radially outermost cutter elements on blades 125, 126 and gage pads 145, 146 define the gage contact surface of the bit. The circumferential extent of the gage contact surface for the embodiment shown is indicated by θ. It will be recognized that θ can be increased by increasing the distance between axis 111 and axis 133. On the other hand, as the distance between axis 111 and axis 133 is increased, the imbalance force due to gage cutting also increases, making it more difficult to force-balance the bit.

Thus, pass-through circle 117 defines the pass-through diameter and geometric axis 111 is also the pass-through axis of the bit. As described above, the pass-through diameter is the smallest diameter through with bit 100 can pass and is illustrated as $D_P$ in FIG. 3. Likewise, gage circle 119 defines the diameter of the drilled hole, which is illustrated as $D_H$ in FIG. 3.

It will be recognized by those skilled in the art that the cutter elements on blades 125 and 126 will cause an imbalance force that can be represented by the force vector $F_1$. In accordance with the principles of the present invention, the cutter elements on the remaining blades 121–124 are arranged and configured so as to generate an opposing imbalance force $F_2$, whose magnitude is as nearly equal to the magnitude of $F_1$ as possible. In practice, it may be preferred to minimize the total imbalance force on the bit by making the circumferential imbalance force $F_{cir}$ and the radial imbalance force $F_{rad}$ as close in magnitude and as directly opposed as possible. Regardless, the total imbalance force will be the vector sum of the two forces, either $F_1$ and $F_2$ or $F_{cir}$ and $F_{rad}$. Thus, according to the present invention, this vector sum is minimized.

Furthermore, the axial separation $x_{new}$ (along rotation axis 133) between the forces is also minimized according to the present invention. Using the same equation as above, the combined application of these balanced imbalance forces produces a torque on bit 100 whose component about an axis normal to the axis of rotation 133 is likewise minimized, and is preferably zero. Whereas a minimum foreseeable axial offset x for the conventional bit described above is ten inches, a maximum foreseeable axial offset $x_{new}$ for the present bit is only five inches. Thus, using the data from the example above, if the total imbalance force on the bit is equal to 0.1 WOB, the magnitude of the turning moment would be only half the magnitude of the WOB. In the preferred and more likely case where the axial offset $x_{new}$ is less than five inches, the turning moment will be even smaller. In this way, the present bit substantially eliminates many of the steering and directional problems associated with conventional bi-center bits.

Figure 1:
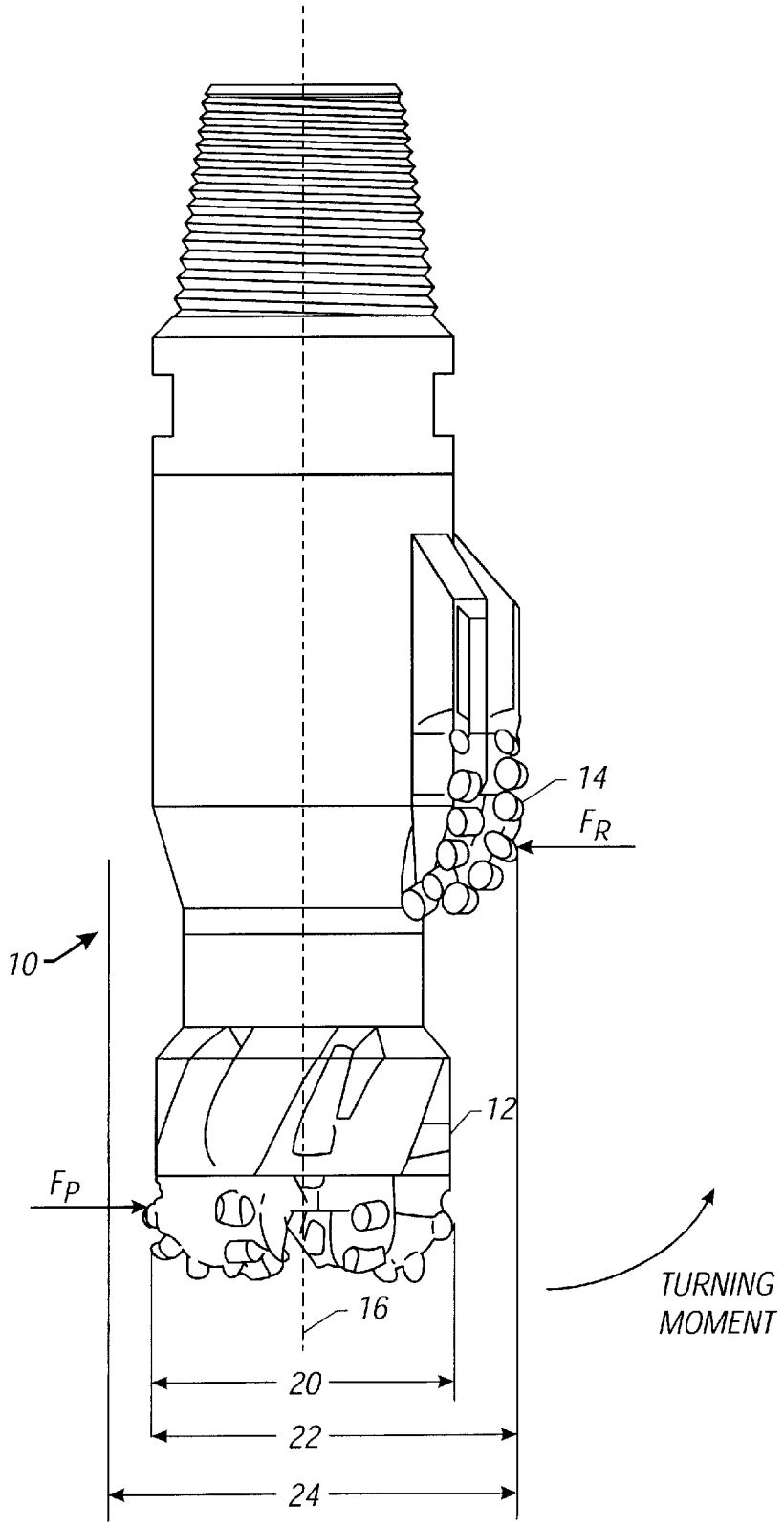
FIG. 1 is a side elevation of a conventional bi-center bit, showing the axial offset, pilot bit diameter, drilling diameter and pass-through diameter.
Figure 4:
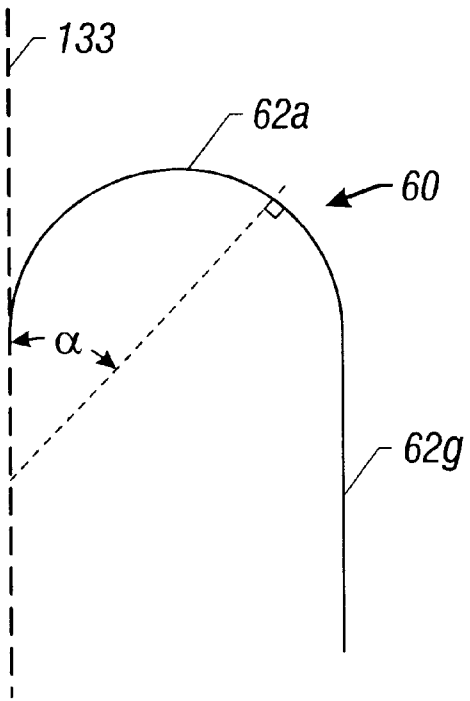
FIG. 4 is a simplified schematic drawing of one-half of the profile of a bi-center bit constructed in accordance with principles of the present invention.
Figure 1A:
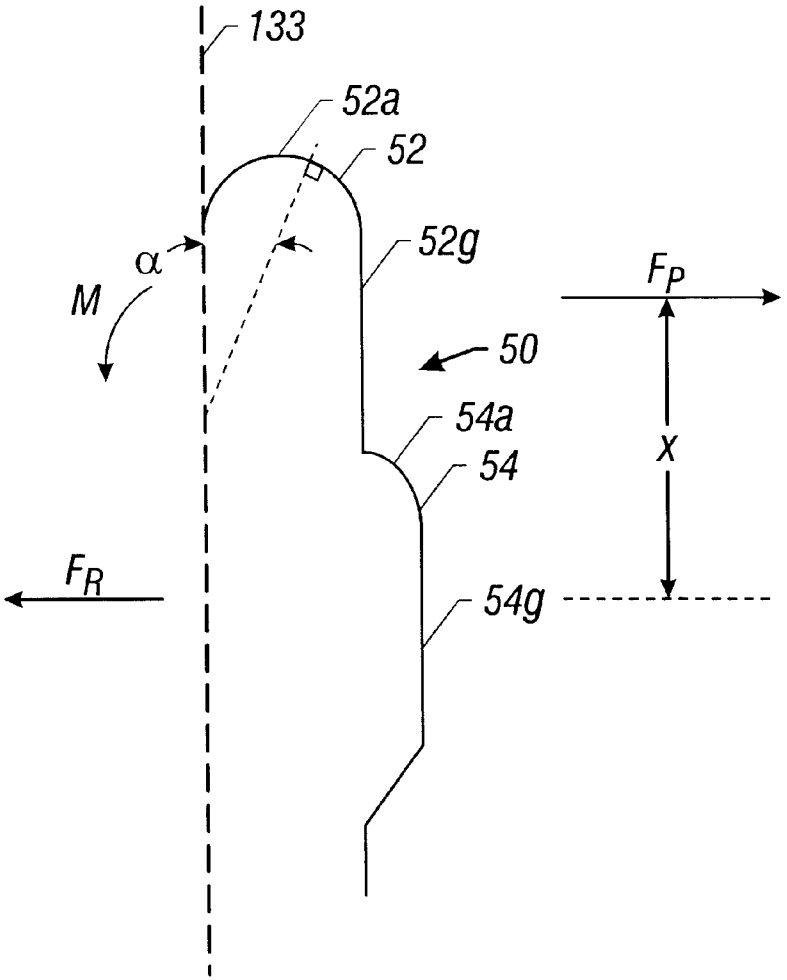
FIG. 1A is a simplified schematic drawing of one-half of the profile of a conventional-type bi-center bit.

Referring briefly now to FIG. 4, a simplified single revolved profile 60 of a bi-center bit constructed in accordance with the present invention comprises a single curve $\mathbf{62}_a$ and adjacent gage portion $\mathbf{62}_g$. Thus, $\alpha$ increases continuously from zero or negative at the inner point of profile 62 to approximately 90° at the outer point and gage portion and does not decrease at any point along the profile.

Because the diameter of the gage circle 119 is significantly larger than the diameter of pass-through circle 117, the present bit is suitable for typical under-reaming jobs. Also, because there is no axial separation between a pilot section and a reamer section, it is much easier to ensure that the fluid flow from nozzles 150 is evenly and effectively distributed across the cutting face 112, so as to adequately cool the cutter elements and prevent clogging of the bit.

It is possible to force balance a PDC bit because there are six degrees of freedom, which are: backrake, side rake, profile angle, and longitudinal, radial and angular position. A preferred technique for arranging the cutter elements on the bit surface so as to achieve a balance of imbalance forces comprises an iterative finite elements analysis of the total forces acting on the bit by all the cutters.

Figure 5:
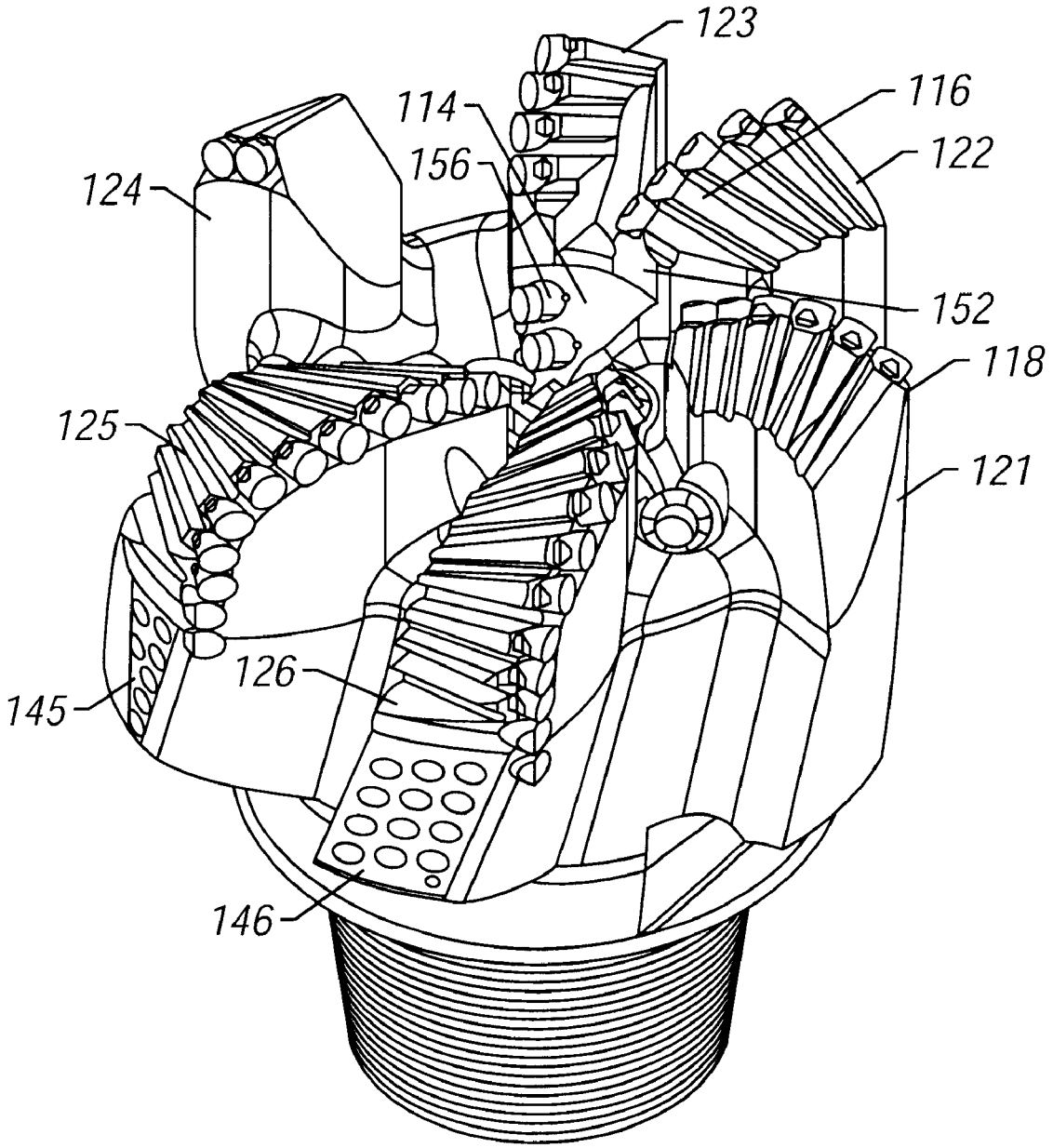
FIG. 5 is a perspective view of the bit of FIG. 2.

Still according to a preferred embodiment, as best shown in FIG. 5, cutting face 112 includes a recessed portion 114, a generally conical portion 116, and a pass-through circumference 118. Recessed portion 114 is preferably centered on axis of rotation 133. Recessed portion 114 is generally cylindrical and is defined by a smooth inner wall 152 and a bottom surface 154. Bottom surface 154 preferably includes cutter elements 156, whose contribution to the imbalance force is included in the calculation described above. In an alternative embodiment, the side wall 152 of recessed portion 114 includes cutting elements or other surface features. Recessed portion 114 may have any preferred depth, such as for example about 0.5 to 1.5 inches for a 12½ inch bit. Larger bits may have a deeper recessed portion 114, while smaller bits may have a shallower recessed portion 114. While recessed portion 114 is preferred, it is not necessary and can be omitted.

As the bit 100 drills, blades 124–126 cut a hole having a diameter $D_H$ (FIG. 3). The cutter elements on the remaining blades exert cutting forces that counteract the forces generated by the large diameter blades. A short "core" is formed as conical portion 116 and shoulder 117 advance through the formation. This core is received in recessed portion 114 and ultimately contacts and is cut by the cutter elements 156 on bottom surface 154. Thus, the core is continuously being cut during drilling, just as the formation at the center of a conventional bit would be cut continuously. The creation of a core that extends into the bit body allows the core to be used as a bearing surface. This bearing surface serves to provide additional stability so to maintain the true rotational center (axis 133).

It is preferred that the diameter of the hole $D_H$ be at least 10% greater than the passthrough diameter $D_P$. More preferably, the diameter of the hole $D_H$ is at least 15% greater than the pass-through diameter $D_P$. To accomplish this, the lateral offset between the axis of rotation 133 and the geometric center of the bit is at least 5%, and more preferably 7.5% of the passthrough diameter.

While the bi-center bit of the present invention has been described according to a preferred embodiment, it will be understood that departures can be made from some aspects of the foregoing description without departing from the spirit of the invention. For example, the size, number and configuration of the blades can be varied, as can the size of the bit itself. In general, the principles described herein can be applied to any PDC bit, and many of the devices known in the art, such as tracking cutters, stability enhanced cutting structures and an advanced hydraulic layout can be incorporated in bits constructed in accordance with the present invention.

What is claimed is:

1. A drill bit for drilling a hole having a diameter greater than a diameter of a smallest opening through which the drill bit can pass, the drill bit comprising:

a bit body having an axis of rotation;

a cutting surface at one end of the bit body having a geometric axis laterally offset from the axis of rotation, the cutting surface comprising a plurality of blades arranged at substantially the same axial position, wherein at least one of the blades has a greater radial extent from the axis of rotation than the other blades; and a plurality of cutter elements affixed to the blades at selected positions along each blade.

2. The drill bit of claim 1, wherein the geometric axis is laterally offset from the axis of rotation by at least 5% of the diameter of the smallest opening through which the drill bit can pass.

3. The drill bit of claim 2, wherein the geometric axis is laterally offset from the axis of rotation by approximately 7.5% of the diameter of the smallest opening through which the drill bit can pass.

4. The drill bit of claim 1, wherein the cutting surface further comprises a central recessed portion centered proximal to the axis of rotation.

5. The drill bit of claim 4, wherein the recessed portion comprises a smooth, generally cylindrical wall and a bottom surface.

6. The drill bit of claim 5, wherein the recessed portion further comprises at least one cutter element.

7. The drill bit of claim 6, wherein the recessed portion further comprises a plurality of cutter elements.

8. The drill bit of claim 1, further comprising fluid discharge nozzles disposed proximal to the cutting surface.

9. The drill bit of claim 1, wherein the cutter elements comprise polycrystalline diamond compact inserts.

10. The drill bit of claim 1, wherein the selected positions of the cutter elements are selected so that lateral forces exerted by the cutter elements on the blades substantially balance.

11. The drill bit of claim 10, wherein the selected position of each cutter element is selected by adjusting at least one variable selected from the group consisting of back rake, side rake, profile angle, longitudinal position, radial position and angular position to minimize a total lateral imbalance force exerted on the drill bit during drilling.

12. The drill bit of claim 10, wherein the plurality of blades are arranged at substantially the same axial position so that the axial separation between the lateral forces exerted by the cutter elements on the blades is minimized to produce a turning moment on the bit that is substantially zero.

13. The drill bit of claim 1, wherein each of the blades comprises a bit profile defined by a single curved portion and an adjacent linear gage portion, wherein an angle between a line perpendicular to the profile and the axis of rotation of the bit body generally increases continuously from zero or negative for an inner point along the profile to approximately 90° for an outer point along the profile.

14. A drill bit for drilling a hole in a formation having a diameter greater than a diameter of an opening through which the drill bit can pass, the drill bit comprising:

a bit body having an axis of rotation;

a plurality of blades azimuthally spaced apart on one end of the body at substantially the same axial position along the axis of rotation, wherein at least one of the blades has a greater radial extent from the axis of rotation than the other blades, the blades defining a cutting surface having a geometric axis laterally offset from the axis of rotation; and a plurality of cutter elements attached to the blades at selected positions so that lateral forces exerted by the cutter elements on the blades substantially balance.

15. The drill bit of claim 14, where in the cutting surface further comprises a central recessed portion proximal to the axis of rotation.

16. The drill bit of claim 15, wherein the recessed portion comprises a smooth, generally cylindrical wall and a bottom surface.

17. The drill bit of claim 16, wherein the recessed portion further comprises at least one cutter element.

18. The drill bit of claim 14, further comprising fluid discharge nozzles disposed proximal to the cutting surface.

19. The drill bit of claim 14, wherein the geometric axis is laterally offset from the axis of rotation by at least 5% of the diameter of the smallest opening through which the drill bit can pass.

20. The drill bit of claim 19, wherein the geometric axis is laterally offset from the axis of rotation by approximately 7.5% of the diameter of the smallest opening through which the drill bit can pass.

21. The drill bit of claim 14, wherein the cutter elements comprise polycrystalline diamond compact inserts.

22. The drill bit of claim 14, wherein the blades comprise a bit profile defined by a single curved portion and an adjacent linear gage portion, wherein an angle between a line perpendicular to the profile and the axis of rotation of the bit body generally increases continuously from zero or negative for an inner point along the profile to approximately 90° for an outer point along the profile.

23. The drill bit of claim 14, wherein the selected position of each cutter is selected by adjusting at least one variable selected from the group consisting of back rake, side rake, profile angle, longitudinal position, radial position and angular position to minimize a total lateral imbalance force exerted on the drill bit during drilling.

24. A bi-centered drill bit, comprising:

a bit body having an axis of rotation;

a cutting surface on one end of the bit body having a geometric axis laterally offset from the axis of rotation, the cutting surface comprising a plurality of blades arranged at azimuthally spaced apart locations at substantially the same axial position, wherein at least one of the blades has a greater radial extent from the axis of rotation than the other blades;

a plurality of cutter elements spaced apart and affixed to the blades at selected positions along each blade; and a bit profile along the blades defined by a single curved portion and an adjacent linear gage portion, wherein an angle between a line perpendicular to the profile and the axis of rotation of the bit body generally increases continuously from zero or negative for an inner point along the profile to approximately 90° for an outer point along the profile.

25. The drill bit of claim 24, where in the cutting surface further comprises a central recessed portion centered proximal to the axis of rotation, the central recess portion comprising a generally cylindrical wall and a bottom surface.

26. The drill bit of claim 25, wherein the recessed portion further comprises at least one cutter element.

27. The drill bit of claim 26, wherein the recessed portion further comprises a plurality of cutter elements.

28. The drill bit of claim 24, further comprising fluid discharge nozzles disposed proximal to the cutting surface.

29. The drill bit of claim 24, wherein the geometric axis is laterally offset from the axis of rotation by at least 5% of a diameter of a smallest opening through which the drill bit can pass.

30. The drill bit of claim 29, wherein the geometric axis is laterally offset from the axis of rotation by approximately 7.5% of the diameter of the smallest opening through which the drill bit can pass.

31. The drill bit of claim 24, wherein the selected positions for the cutter elements are selected so that lateral forces exerted by the cutter elements on the blades substantially balance.

32. The drill bit of claim 31, wherein the selected position of each cutter is selected by adjusting at least one variable selected from the group consisting of back rake, side rake, profile angle, longitudinal position, radial position and angular position to minimize a total lateral imbalance force exerted on the drill bit during drilling.

33. The drill bit of claim 24, wherein the cutter elements comprise polycrystalline diamond compact inserts.

* * * * *

UNITED STATES PATENT AND TRADEMARK OFFICE

CERTIFICATE OF CORRECTION

PATENT NO. : 6,039,131

DATED : March 21, 2000

INVENTOR(S) : Timothy P. BEATON

It is certified that error appears in the above-identified patent and that said Letters Patent is hereby corrected as shown below:

In Column 2, line 41, please replace "a"; with -- α --.

Signed and Sealed this

Twentieth Day of March, 2001

*Attest:*

NICHOLAS P. GODICI

*Attesting Officer*

*Acting Director of the United States Patent and Trademark Office*